US005251821A

United States Patent [19]

Toth

[11] Patent Number: 5,251,821

[45] Date of Patent: Oct. 12, 1993

[54] PAINT SPRAY GUN

[75] Inventor: Denis W. Toth, Pontiac, Mich.

[73] Assignee: Can-Am Engineered Products, Inc., Livonia, Mich.

[21] Appl. No.: 792,468

[22] Filed: Nov. 13, 1991

[51] Int. Cl.[5] ..... B05B 1/28

[52] U.S. Cl. ..... 239/297; 239/300; 239/124

[58] Field of Search ..... 239/290, 296, 297, 300, 239/124, 273, 282, 283; 222/180; 901/43; 403/290, 312, 344

[56] References Cited

U.S. PATENT DOCUMENTS

| | | | |
|---|---|---|---|
| 2,553,401 | 5/1951 | Carr | 239/290 |
| 3,685,736 | 8/1972 | Diegelman | 239/296 |
| 3,709,190 | 1/1973 | Von Gottberg et al. | 901/43 |
| 3,737,099 | 6/1973 | Shaffer | 239/707 |
| 4,300,198 | 11/1981 | Davini | 901/43 |
| 4,422,348 | 12/1983 | Campbell | 403/344 |
| 4,650,119 | 3/1987 | Pomponi, Jr. | 239/296 |
| 4,744,518 | 5/1988 | Toth | 239/297 |
| 4,957,388 | 9/1990 | Liu | 403/290 |
| 5,040,732 | 8/1991 | Anderson et al. | 239/124 |

FOREIGN PATENT DOCUMENTS

| | | | |
|---|---|---|---|
| 0404702 | 12/1990 | European Pat. Off. | 239/297 |
| 615895 | 9/1959 | Italy | 239/290 |
| 683455 | 11/1952 | United Kingdom | 239/290 |

*Primary Examiner*—Andres Kashnikow
*Assistant Examiner*—Christopher G. Trainor
*Attorney, Agent, or Firm*—Weintraub, Duross & Brady

[57] ABSTRACT

A paint spray gun is provided with a mounting bracket for mountably supporting the housing of the gun. The bracket has a clamping section with a substantially circular opening therein. The bracket includes a split ring for clamping the gun within the circular opening, and has a shaft extending outwardly from the clamping section for mounting in a support. The mounting bracket allows placement of plural guns in close proximity for specialty work. The gun may further be provided with a thumb operated wheel disposed in a recess in the housing for controlling the flow of fanning air, and may have the needle which controls paint flow fixedly attached to an actuator piston assembly. In a preferred embodiment, all of the seals within the gun are formed from a material which will not swell or deteriorate when the gun is immersed in an organic solvent for a period of three hours. Preferred material for the seals is polytetrafluoroethylene.

4 Claims, 3 Drawing Sheets

PAINT SPRAY GUN

BACKGROUND OF THE INVENTION

1. Field of the Invention

The present invention relates to paint spray guns. More particularly, the present invention relates to a paint spray gun which includes a mounting clamp which allows rotatable movement of the gun body therein.

2. Prior Art

In conventional paint spray guns, a stream of paint under pressure is discharged from a relatively small orifice in a nozzle. At the same time, pressurized air is discharged radially into the stream, from an annular opening surrouding the nozzle, immediately adjacent the paint discharge orifice to atomize the stream of paint into a spray of fine droplets. The spray thus moves away from the gun in an expanding conical pattern whose apex is at the nozzle.

It is frequently preferred to modify the circular cross-section of the normal conical spray pattern so as to transform the cross-section into a narrowed and elongated generally elliptically shaped cross-section, so that the spray pattern more closely resembles a flat-sided fan or a parabola than a cone when viewed from the side. This modification of the spray pattern allows for more efficient and controlled painting than is obtainable with a conical spray.

In many prior art spray guns, fanning of the spray pattern is often accomplished by providing an air cap at the front section of the gun. The air cap normally has a pair of substantially diametrically opposed fanning air passageways formed therein which terminate at outlets which are spaced outwardly from opposing sides of the annular air discharge opening. The fanning air passageways are oriented to direct air jets toward opposite sides of the spray pattern at a location spaced a short distance forward of the nozzle orifice. These jets have the effect of flattening the sides of the conical spray pattern. At any given distance from the nozzle, this flattening effect transforms the normally circular cross-section of the spray pattern into a generally elliptically shaped cross-section whose major axis is somewhat greater than the original cone diameter and whose minor axis is somewhat less than the original cone diameter. This "flatness" of the spray pattern will increase with an increase in the pressure at which are expelled from the fanning ports. A brief review of some previously published patents on paint spray guns follows.

Carr, U.S. Pat. No. 2,553,401 discloses an air-actuated paint spray gun of the general type described above. The gun of Carr uses only a single source of compressed air to atomize the paint issuing from the nozzle as well as to actuate a piston which moves to overcome a restraining spring and to displace a needle out of the nozzle orifice to release the flow of paint. Because a single source of air is used to perform both of these functions in Carr, a "lost motion" connection is used between the piston and the needle which restricts the nozzle orifice. However, this type of connection requires a separate spring to bias the needle into a normally closed position even when the piston has begun movement within the body of the gun, and does not allow for adjustment of the pressure to the fanning outlets independent of the pressure which turns the gun on and off. Thus, fine control of the shape of the spray pattern could be difficult with the design of Carr. In addition, the spray gun of Carr uses a fairly complicated venting system to release air from behind the piston, the venting system involving a rotating cam and a spring-loaded valve in communication with the piston chamber.

U.S. Pat. No. 4,744,518 to Toth, who is the present applicant, discloses a manually actuated paint spray gun which is also of the general type described above, and which further has a mechanically operated air cylinder which is movable within the gun to obstruct or not to obstruct the fanning air passageways in the air cap. Movement of the air cylinder with respect to the air cap allows for control of the pressure leaving the fanning ports, and thus allows a user of the gun to control the shape of the spray pattern.

SUMMARY OF THE INVENTION

The present invention provides an improved paint spray gun of the type including a housing, an annular air cap mounted at the forward end of the housing and having a central air discharge opening formed coaxially centrally therethrough, a nozzle mounted on the housing which extends though the air discharge opening of the air cap, the nozzle having an orifice formed at its forward end for discharging paint under pressure in a forwardly directed stream, the housing having a first passage formed therethrough for supplying paint to the nozzle, and a second passage formed therethough for supplying pressurized air to the air discharge opening to atomize paint discharge from the nozzle into a spray pattern, the air cap having a third passage formed therethrough which communicates with the second passage of the housing for discharging air from opposite sides of the air cap to flatten the spray pattern.

In one embodiment hereof, the improvement of the present invention comprises:

a mounting bracket for mountably supporting the housing, the bracket comprising:

a clamping section having a substantially circular opening formed therein to receive the housing;

means for clamping the housing within the circular opening; and a shaft extending outwardly from the clamping section for mounting in a support.

The paint spray gun hereof may have a valve member in the housing, which is adjustably movable between an open position and a closed position, for adjusting the flow of air from the second passage to the third passage, and a knurled cylindrical control wheel which is disposed in a recess formed in the housing, and which is rotatable to adjust the position of the valve member.

In a preferred embodiment hereof, the gun has a plurality of internal seals to confine fluid flow, every seal being formed from a material which will retain its shape and size even when the gun is immersed in an organic solvent for three hours or more. Most preferably, all seals in the gun are formed from polytetrafluoroethylene (PTFE).

The paint spray gun of the present invention is, preferably, an air-actuated gun, having a cylindrical bore formed in the housing to receive a piston, the gun further comprising a needle which is slidably movable within the housing to control paint flow out of the nozzle, and a piston which is slidably movable in the bore, the piston being fixedly attached to the needle for simultaneous movement therewith, and an end cap which attaches to the back end of the housing; wherein the end cap, the bore in the housing, and the piston with its associated seal cooperatively define a closed chamber which is not vented, the housing having a fourth passage formed therein to admit air into the bore forward of the piston.

For a more complete understanding of the present invention, the reader is referred to the following detailed description section, which should be read in conjunction with the drawings. Throughout the following description and in the drawings, like numbers refer to like parts throughout the several views, in which:

DETAILED DESCRIPTION OF THE PREFERRED EMBODIMENTS

Figure 1:
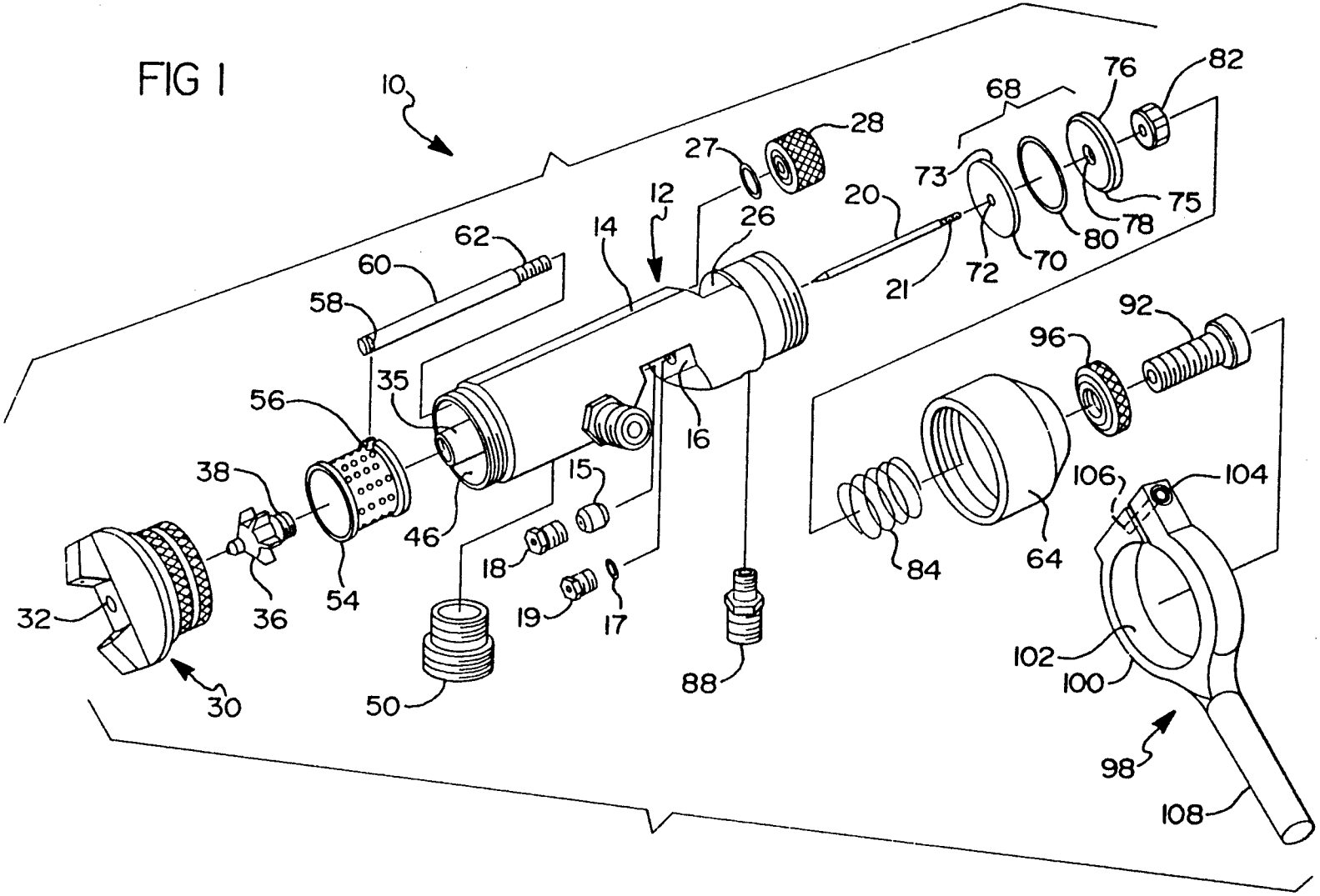
FIG. 1 is an exploded perspective view of a paint spray gun in accordance with a first embodiment of the present invention.

Referring now to the drawings, a paint spray gun in accordance with a first embodiment of the present invention is shown generally at 10. The gun 10 is an air-actuated gun and includes a main housing 12 having a generally cylindrical exterior shape, with some modifications from a purely cylindrical shape as will be further detailed hereinafter. It is preferred that the housing be formed from a strong durable material such as aluminum or a tough rigid plastic.

The housing 12 has a flat reference surface 14 formed along the side thereof which may function as a gauge when setting up the gun for a particular job. The flat surface 14 lies along a plane which is parallel to the longitudinal axis of the housing 12. This surface forms a reference plane for the purpose of aiming the spray gun. The surface 14 may have a recessed groove formed along the extension thereof, the groove being parallel to and directly above a central needle 20 to further aid in aiming of the gun 10. The housing has a major recess 16 cut out of the side and central portion thereof, to provide access for the installation and removal of a pair of externally threaded hollow packing screws 18, 19 which serve to support and guide the needle 20 which is disposed centrally within the housing 12 along the longitudinal axis thereof. A pair of threaded holes 22, 24 are formed coaxially within the housing 12 on opposite sides of the major recess 16 to threadably receive the packing screws 18, 19 respectively.

The housing also has a minor recess 26 formed therein to receive a knurled cylindrical fan adjustment knob 28. The minor recess 26 is substantially opposite the major recess 16 and located rearwardly of the major recess 16. The front end of the housing 12 has threads formed therearound, and an annular air cap 30, which is of conventional construction, fits threadingly thereon. The air cap 30 has a central air discharge opening 32 formed coaxially therethrough, and also has a pair of opposed fanning air conduits 31, 33 formed therethrough which terminate in substantially diametrically opposed fanning air ports 31*a*, 33*a* respectively.

The housing 12 includes a centrally located coaxial paint tube 35 which has a central passage formed coaxially in the front portion thereof which defines a first passage 34 for supplying paint to a nozzle 36. The forwardmost portion of the first passage 34 has threads formed therein to threadingly receive a threaded portion 38 of the nozzle 36 therein. The nozzle 36 is also generally of conventional construction. Preferably, the threaded portion 38 is tapered to assure a sealing fit of the nozzle 36 in the housing 12. The first passage branches off to the exterior surface of the housing 12 by way of a threaded connecting channel 40 which receives a fluid fitting 42 therein to accept paint into the gun 10. The fluid fitting 42 thus defines a paint inlet. As noted, the housing 12 has a coaxial paint tube 35 which contains the first passage 34 for supplying paint to the nozzle 36 at the front of the gun 10. Preferably, the paint tube 35 is formed as a removable stainless steel member and directly receives the fluid fitting 42 therein, so that all surfaces which contact paint are formed from stainless steel or from another material which does not react substantially with the paint.

The nozzle 36 has a central coaxial passageway 35 formed therethrough, which terminates in an orifice 44 from which paint passes outwardly in a forwardly directed stream. The forwardmost tip of the needle 20 is received within the passageway 35 of the nozzle and the nozzle 36 with the needle 20 therein provides a valve to control or prevent paint flow outwardly from the gun 10.

An annular chamber 46 is formed coaxially in the front of the housing and surrounds the paint tube 35 to define part of a second passage 48 formed through the housing 12, to supply pressurized air to the air discharge opening 32 of the air cap 30, to atomize paint discharged from the nozzle into a spray pattern. The second passage 48 begins at a threaded portion 49 which threadingly receives an air inlet fitting 50 therein.

A hollow spool-shaped fan adjusting piston 54 fits slidably within the annular chamber 46, and the fan adjusting piston 54 may be foraminous as shown to facilitate air flow therethrough, therearound, and generally in the second passage 48. The housing 12 also has a relatively narrow cylindrical through bore 52 formed therethrough which interconnects the annular chamber 46 with the minor recess 26.

The two fanning air conduits 31, 33 of the air cap together define a third air passage which, ordinarily, is in fluid communication with the second air passage 48 of the housing. The fan adjusting piston 54, however, provides a means for regulating air flow through the fanning air conduits 31, 33. When the fan adjusting piston 54 is in its forwardmost position, as illustrated in solid lines in FIG. 2, air flow through the fanning air conduits 31, 33 is substantially prevented. The fan adjusting piston 54 has a T-shaped slot 56 formed therein at the top of the back end thereof, as shown, to engagingly receive the end of an actuator rod 60 therewithin for coordinated movement of the fan adjusting piston 54 with the rod 60. The forward end of the rod 60 has a pair of vertical slots 58 formed therein on opposite sides thereof, so that the front tip of the actuator rod 60, when seen from above, has a T-shape which fits engagingly into the T-shaped slot 56 of the fan adjusting piston 54. The actuator rod 60 fits slidably within the cylindrical through bore 52 of the housing and the back end 62 of the rod 60 has threads formed thereon which are threadingly received in the center of the fan adjustment knob 28. Thus, by rotating the recessed fan adjustment knob 28, the operator of the gun 10 is able to slidably move the actuator rod 60. The rod 60, in turn, moves the fan adjusting piston 54 with respect to the air cap 30 to regulate the flow of fanning air outwardly from the fanning air ports 31*a*, 33*a*. Since the adjustment knob 28 is located within the minor recess 26 in the housing 12, its durability and longevity is increased as compared with locating the adjusting knob 28 in another, more exposed location.

The back end of the housing 12 also has threads formed therearound and threadingly receives an end cap 64 thereon. A large, hollow, cylindrical bore 66 is formed coaxially in the back end of the housing 12, and a three-part trigger piston assembly 68 fits sealingly within the bore 66. The trigger piston assembly 68 includes a front plate 70 having a threaded bore 72 formed through the center thereof, the front plate 70 having a chamfered outer back edge 73 and a rearwardly extending cylindrical boss 74 formed integrally thereon. The piston assembly 68 also includes a back plate 76 having a cylindrical hole 78 formed therethrough, and a chamfered outer front edge 75. A circular seal 80 fits between the chamfered edges 73, 75 of the front and rear plates 70, 76 and the cylindrical boss 74 of the front plate 70 fits within the hole 78 of the back plate 76. A needle lock nut 82 fits over the threaded back end 21 of the needle 20 and serves to fix the piston assembly 68 in place on the needle 20. The needle 20 is thus affixed to the piston assembly 68 for simultaneous movement therewith. While a one-piece piston (not shown) could be used in the gun 10 of the present invention as an equivalent of the piston assembly 68, it is preferred that the seal 80 be formed of PTFE for reasons which will subsequently be detailed herein. Since PTFE is a relatively non-stretchable material, the two-piece piston design of the assembly 68 is preferred.

A single coil spring 84 fits over the lock nut 82 and abuts against the back plate 76 to bias the piston assembly 68, and the needle 20 which is affixed thereto, forwardly in the housing 12. When there is no air pressure applied to the front plate 70, the spring 84 acts to push the needle 20 forwardly inside the nozzle 36 to block the flow of paint therethrough.

A fourth passage 86 is formed in the housing between the front of the bore 66 and the exterior of the housing 12. The fourth passage 86 threadingly receives a trigger air fitting 88 therein. While the gun 10 hereof uses turbine air from a turbo-compressor (not shown) to provide both atomizing air to the air discharge opening 32 and to provide fanning air to the fanning air conduits 31, 33, the turbine air being relatively low-pressure, high-volume air, it is preferred to use higher pressure compressed air in the range of 45–65 psi to control movement of the piston assembly 68 within the gun 10. The use of separate and independent air supplies for the air cap 30 and the piston control 54 allows for the use of only a single spring 24 to bias the needle 20 and piston assembly 68 forward as an integral unit, since the air to the air cap 30 can be allowed to run substantially continuously, thus avoiding any problems of spattering paint when the needle 20 is first moved back out of the nozzle 36.

A threaded bore 90 is provided coaxially through the center of the end cap 64, and a fluid adjusting screw 92 fits threadingly and engagingly therein. The fluid adjusting screw 92 has a central bore 94 formed coaxially therein to receive the back end 21 of the needle 20 therein so that the front end of the fluid adjusting screw 92 can abut against the needle lock nut 82 without interference from the needle 20. An additional lock nut 96 is provided surrounding the fluid adjusting screw 92 externally of the end cap 64, to fix the position of the fluid adjusting screw 92 in the end gap 64. The fluid adjusting screw 92 acts as a stop to set the rearward limit to the travel of the piston assembly 68 with the needle affixed thereto. The setting of the fluid adjusting screw 92 therefore controls the maximum rate of flow out of the nozzle 36. It should be noted that the fourth passage 86 provides the only inlet and the only outlet to the bore 66 when the end cap, with the fluid adjusting screw 92 attached thereto, is installed on the housing. When the piston assembly 68 is located between the trigger air fitting 88 and the end cap 64, no outlet or inlet is provided behind the piston assembly 68. The end cap 64, the piston assembly 68, and the housing 12 thus cooperate to define a closed chamber which acts as a shock absorber to dampen and cushion rearward movement of the piston assembly 68, with the needle 26 affixed thereto, in response to air pressure on the front of the piston assembly 68.

As noted above, the housing 12 is of a generally cylindrical shape. The paint gun 10 of the present invention also includes a mounting bracket 98 which allows the housing 12 to be rotated to any convenient position. This design allows for two or more guns 10 to be placed in close proximity to one another for speciality work, since each gun can be positioned for optimal placement of supply hoses.

The bracket 98 includes a clamping section 100 formed in the general shape of a split ring, with a substantially circular opening 102 formed therein to receive the housing 12. A bore 106 is formed in the top end of the clamping section 100 as seen in FIG. 1. The innermost portion of the bore 106 of the clamping section 100 has threads formed therein and receives a threaded fastener 104 therein. The portion of the bore 106 which passes through the outermost portion of the clamping section 100 is made slightly larger than the inner portion to allow the fastener 104 to turn freely and nonengagingly with respect thereto. Thus, the split ring design of the clamping section, with the threaded fastener 104 engaged in the bore 106, provides means for clamping the housing within the circular opening. The mounting 98 bracket further includes a shaft 108 which is integrally formed with the clamping section 100 and which extends outwardly therefrom for mounting to a support.

Figure 2:
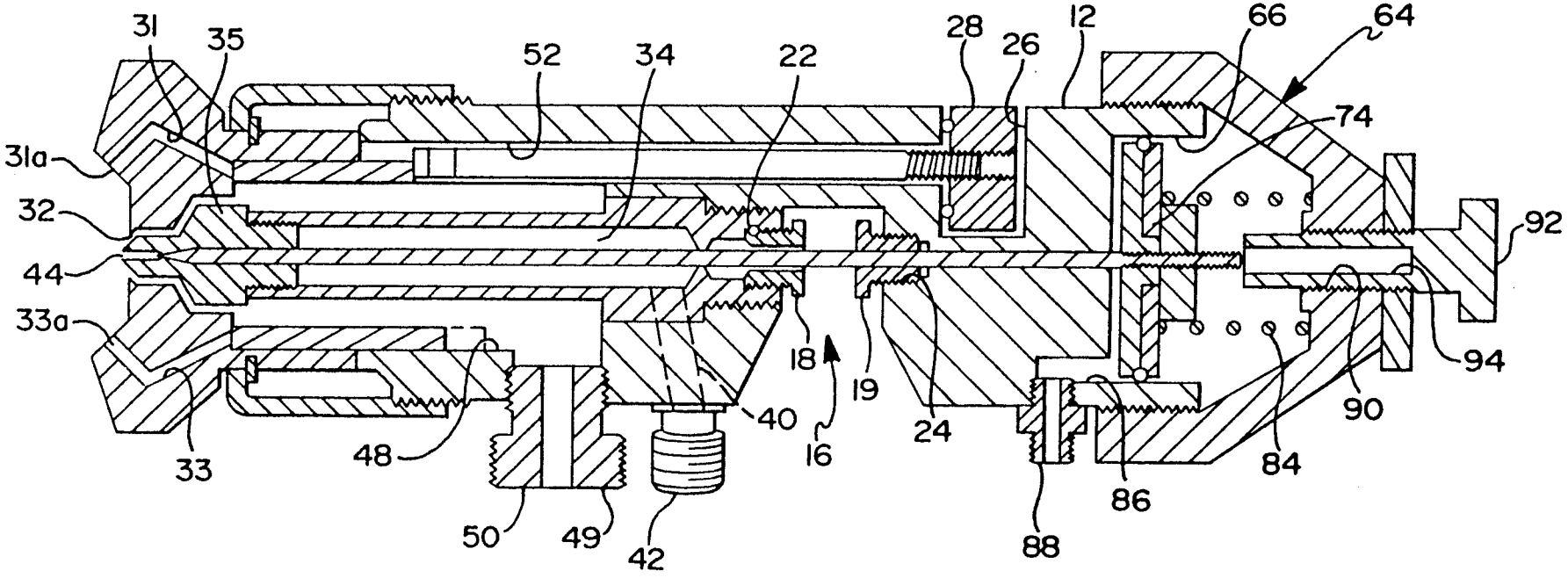
FIG. 2 is a cross-sectional view of the gun of FIG. 1, taken along a substantially vertical plane which passes through the longitudinal axis of the gun.

The gun 10 depicted in FIGS. 1–2 uses four important seals to minimize liquid or air flow therepast. These four seals are the seal 80 associated with the piston assembly 68, a seal 27 associated with the fan adjustment knob 28, and a pair of seals 15, 17 associated with the front and rear packing screws 18, 19, respectively. It is preferred in the practice of the present invention, that every one of the seals used in the gun should be formed from a material which will retain its shape and size even when the entire gun is immersed in an organic solvent, such as paint thinner, for three hours or more. Swelling of previously used prior art rubber seals becomes a problem with repeated or extended soaking of the gun in paint thinner. It is particularly preferred with the present gun that all of the seals be formed from polytetrafluoroethylene (PTFE), commonly known by the trade name "TEFLON", since PTFE can withstand prolonged soaking in organic solvents without changing its size or sealing ability.

Figure 3:
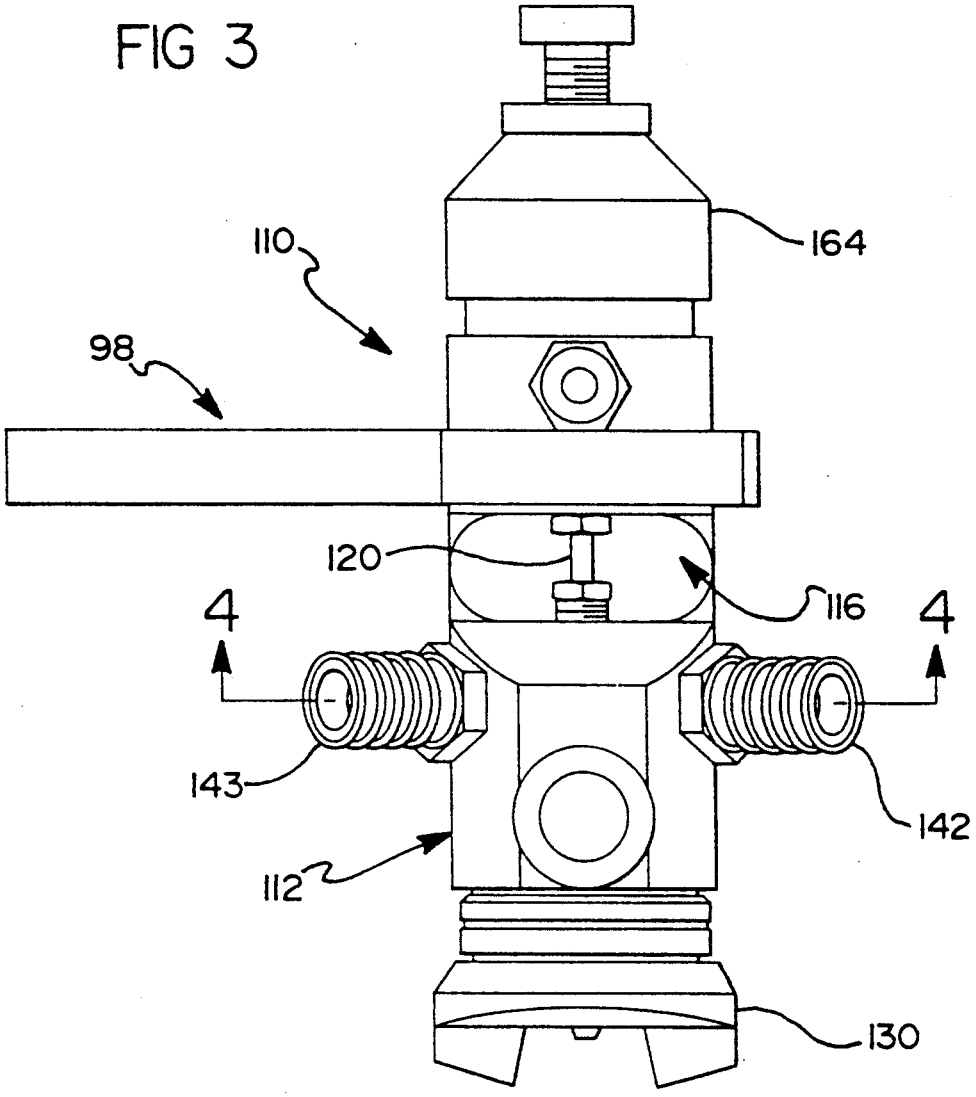
FIG. 3 is a bottom plan view of a second embodiment hereof.
Figure 4:
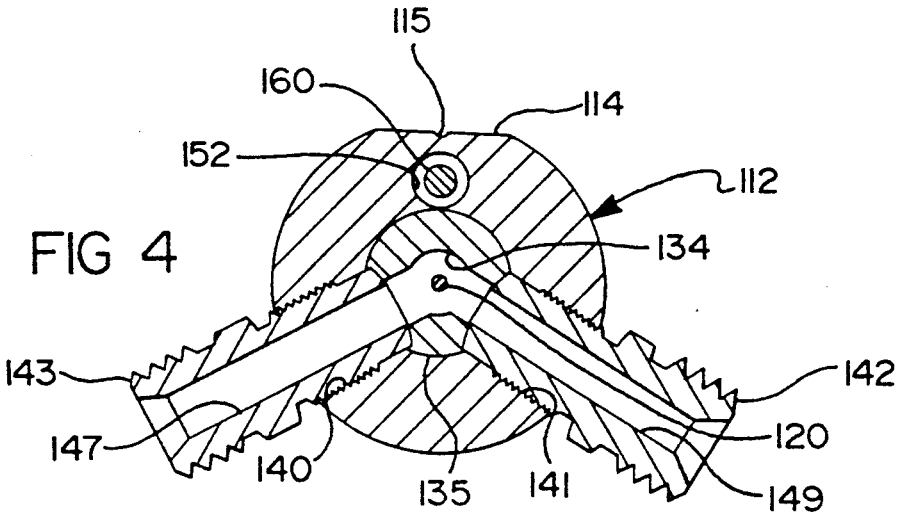
FIG. 4 is a cross section of the gun of FIG. 3, taken along line 4—4.

Referring now to FIGS. 3 and 4, a second embodiment 110 of a paint spray gun in accordance with the present invention is shown. This second embodiment 110 is substantially identical to the first embodiment 10 in all respects, except that the housing 112 thereof is provided with two threaded bores 140, 141 formed therein to accept two fluid fittings 142, 143 therein. Both of the fluid fittings 142, 143 are in fluid communication with the first passage 134 formed in the housing 112. In this second embodiment, a paint recirculation loop is thus established, and paint can be continuously flowed through the housing 112 and returned to the source of paint to ensure continuous agitation of the paint to keep any suspended particles suspended in the paint and to minimize the possibility of such suspended particles settling out the paint within the gun 110. The fluid fittings 142, 143 each have hollow passageways 147, 149 formed therethrough to allow the flow of paint to and from the first passage 134 of the gun. As shown in the drawings, the second embodiment 110 of the paint spray gun, like the first embodiment, includes an air cap 130, a needle 120 which passes centrally through the housing 112, and end cap 164, and a bracket 98 for rotatably supporting the housing 112. The bracket 98 is identical to the bracket 98 in the first embodiment. The housing 112 in the second embodiment also has a major recess 116 formed therein, and this recess 116 can be seen in further detail but is substantially identical to the major recess 16 in the first gun 10. The cross-section of FIG. 4 clearly shows the throughbore 152 analogous to the bore 2 in the first embodiment, with the actuator rod 160 disposed therein. The groove 115 formed in the flat surface 114 and the groove 115 is clearly disposed directly above the needle 120 and is aligned therewith for use in setting up the gun. FIG. 4 also clearly shows that all of the surfaces of the fluid fittings 142, 143 and the paint tube 135 which come into contact with the paint are isolated from the housing 112, and as previously noted, it is preferred that all of the surfaces which contact paint be formed from stainless steel or another material which will not react adversely with the paint.

Although the present invention has been described herein with respect to preferred embodiments thereof, it will be understood that the foregoing description is intended to be illustrative, and not restrictive. Many modifications of the present invention will occur to those skilled in the art. All such modifications which fall within the scope of the present invention are intended to be within the scope and spirit of the present invention are intended to be within the scope and spirit of the present invention.

Having, thus, described the invention, what is claimed is:

1. In a paint spray gun of the type comprising:

a housing, and annular air cap mounted at the forward end of the housing and having a central air discharge opening extending coaxially therethrough;

a nozzle mounted on the housing which extends through the air discharge opening of the air cap, the nozzle having a paint discharge orifice formed at its forward end for discharging paint under pressure in a forwardly directed stream;

a first passage formed through the housing for supplying paint to the nozzle;

a second passage formed through the housing for supplying pressurized air to the air discharge opening to atomize paint discharged from the nozzle into a spray pattern; and a third passage formed in the air cap which communicates with second passage for discharging air from opposite sides of the air cap to flatten the spray pattern, the housing having a cylindrical coaxial bore formed therein to receive a piston assembly, said piston assembly comprising a piston;

the improvements comprising:

(a) a needle which is slidably movable to control paint flow out of the nozzle and the piston which is slidably movable in the bore of the housing, the piston being fixedly attached to the needle for simultaneous movement therewith;

(b) an end cap which attaches to a back portion of the housing, the end cap, the bore of the housing, and the piston cooperating to define a closed chamber which is not vented, the housing having a fourth passage formed therein to admit air into the bore forward of the piston;

(c) a valve in the housing which is adjustably movable between open and closed positions for adjusting the flow of air from the second passage to the third passage;

(d) a cylindrical control wheel which is disposed in a recess in the housing and which is rotatable to adjust the position of the valve;

(e) a spring disposed in the bore behind the piston for biasing the piston and the needle forwardly in the gun;

(f) a mounting bracket for mountably supporting the housing, the bracket having a clamping section with a substantially circular opening formed therein to receive the housing, the bracket comprising means for clamping the housing within the circular opening, the bracket further having a shaft extending outwardly from the clamping section for mounting in a support; and (g) a paint inlet channel and a paint outlet channel formed in the housing to allow continuous recirculation of paint through the gun, wherein both of said paint channels are in fluid communication with the first passage;

and wherein the housing has a flattened portion formed thereon which defines a plane parallel to the longitudinal axis of the housing to aid in the aiming of the gun.

2. The paint spray gun of claim 1, wherein the gun has a plurality of internal seals, said seals being formed from a material which will not swell or deteriorate when the gun is immersed in an organic solvent for a period of three hours.

3. The gun of claim 2, wherein the seals are formed from polytetrafluoroethylene.

4. The gun of claim 1 further comprising a paint tube formed within the forward portion of the housing, the paint tube defining the first passage and separating the first passage from the second passage.

* * * * *